US005611091A

United States Patent [19]

Jensen

[11] Patent Number: 5,611,091

[45] Date of Patent: Mar. 18, 1997

[54] TOILET TRIP LEVER ARM WITH INTEGRAL ENERGY ABSORBING MEMBER

[75] Inventor: Robert M. Jensen, East Brunswick, N.J.

[73] Assignee: American Standard Inc., Piscataway, N.J.

[21] Appl. No.: 423,592

[22] Filed: Apr. 17, 1995

[51] Int. Cl.[6] ..... E03D 5/00

[52] U.S. Cl. ..... 4/405; 4/354

[58] Field of Search ..... 4/354, 405, 410–414, 4/355–359, 360–362

[56] References Cited

U.S. PATENT DOCUMENTS

| | | | |
|---|---|---|---|
| 938,018 | 10/1909 | Opperman | 4/360 |
| 1,457,571 | 6/1923 | Hapgood | 4/412 |
| 2,849,725 | 9/1958 | Armstrong et al. . | |
| 3,026,535 | 3/1962 | Langdon | 4/358 |
| 3,362,030 | 1/1968 | McKinstry | 4/356 |
| 4,233,698 | 11/1980 | Martin | 4/354 |
| 4,624,018 | 11/1986 | Kurtz | 4/325 |
| 4,633,534 | 1/1987 | Hardman | 4/412 |
| 4,791,689 | 12/1988 | De Couto | 4/366 |
| 4,984,311 | 1/1991 | Basile et al. | 4/354 |
| 5,361,426 | 11/1994 | Martin | 4/361 |
| 5,363,513 | 11/1994 | Blankenburg | 4/354 |

FOREIGN PATENT DOCUMENTS 251786 5/1925 United Kingdom .

*Primary Examiner*—Charles E. Phillips

*Attorney, Agent, or Firm*—Ann M. Knab; Elaine Brenner Robinson

[57] ABSTRACT

A toilet trip lever mechanism for use with pressure flush toilets including a coil-type member formed integrally as part of the lever arm. The coil member acts as a shock absorber during the flushing process to absorb kickback during flushing.

7 Claims, 3 Drawing Sheets

TOILET TRIP LEVER ARM WITH INTEGRAL ENERGY ABSORBING MEMBER

BACKGROUND OF THE INVENTION

The present invention is directed to a trip lever for use with low water consumption toilets and particularly to a trip lever for use with pressure assisted toilets.

In the past, conventional flushing mechanisms used in toilet flushing operations generally used one of two different approaches to remove waste material from the toilet bowl. In the first approach, siphoning action was utilized to create a vacuum which drew bowl water and waste water into the drain line and refilled the bowl with fresh water. In a second approach which was typically used in household applications, a tank on the toilet bowl held a predetermined amount of water which, when released, generated a high velocity flow which carried bowl water and waste into the drain line and refilled the bowl with fresh water. The second approach relied on the weight of the water due to gravity to flush and replenish the bowl. Since the weight of the water alone was utilized to flush and replenish the bowl, conventional toilets using this conventional system required about 3 to 5 gallons per flush (GPF).

In response to the increasing concern to conserve water, legislation was enacted requiring reduced water consumption in the flushing of toilets. As of Jan. 1, 1994, toilets must consume less than or equal to 1.6 GPF. As a result, the construction of toilets has changed to compensate for the low water consumption requirements. Changes in construction have included modifications in the design of the trapway, tank and flushing valves. Pressure assisted toilets have become more popular as one solution to reduced water consumption requirements. Pressure assisted toilets typically operate by utilizing pressurized air above the water in the tank to forcibly discharge the water from the tank into the toilet bowl. Although the air pressure in the tank provides an efficient and effective flushing operation, a kickback force is also transmitted to the user from the flush actuation mechanism as it is actuated and released. This can be quite uncomfortable and inconvenient.

The prior art shows the use of springs in connection with toilet trip lever flush arms to absorb the shock or pressure generated during actuation. U.S. Pat. Nos. to Hapgood (1,457,571), Kurtz (4,624,018) and Opperman (938,018) each teach the use of springs independently connected to the toilet trip lever flush arms to absorb shock or pressure generated during actuation of the trip lever arm. None of the prior art uses a shock absorber to absorb pressure generated from pressure assisted toilets. None of the prior art uses a conversion mechanism to convert a push button tank to a side trip lever tank. None of the prior art shows a trip lever arm with an integral energy absorbing member.

Thus, it is apparent that a new type of trip lever mechanism for pressure assisted toilets is desirable in order to reduce the kickback force associated with pressure assisted toilets. It is desirable in providing a trip lever mechanism for a toilet that the mechanism convert button actuated flushing members to side trip lever flushing members.

SUMMARY OF THE INVENTION

It is therefore an object of the invention to reduce kickback occurrences during flushing.

It is another object of the invention to incorporate an anti-kickback member integrally into the lever arm of the flushing system.

It is a related object to convert a push button actuated tank into a trip lever actuated tank.

These and other objects and advantages are achieved by the present invention which provides a coil-type member formed integrally as part of the lever arm which will act as a shock absorber during the flushing process to absorb the kickback occurring during flushing.

BRIEF DESCRIPTION OF THE DRAWINGS

The invention will be more fully appreciated from the following detailed description when same is considered in connection with the accompanying drawings in which.

DETAILED DESCRIPTION OF THE INVENTION

Figure 1:
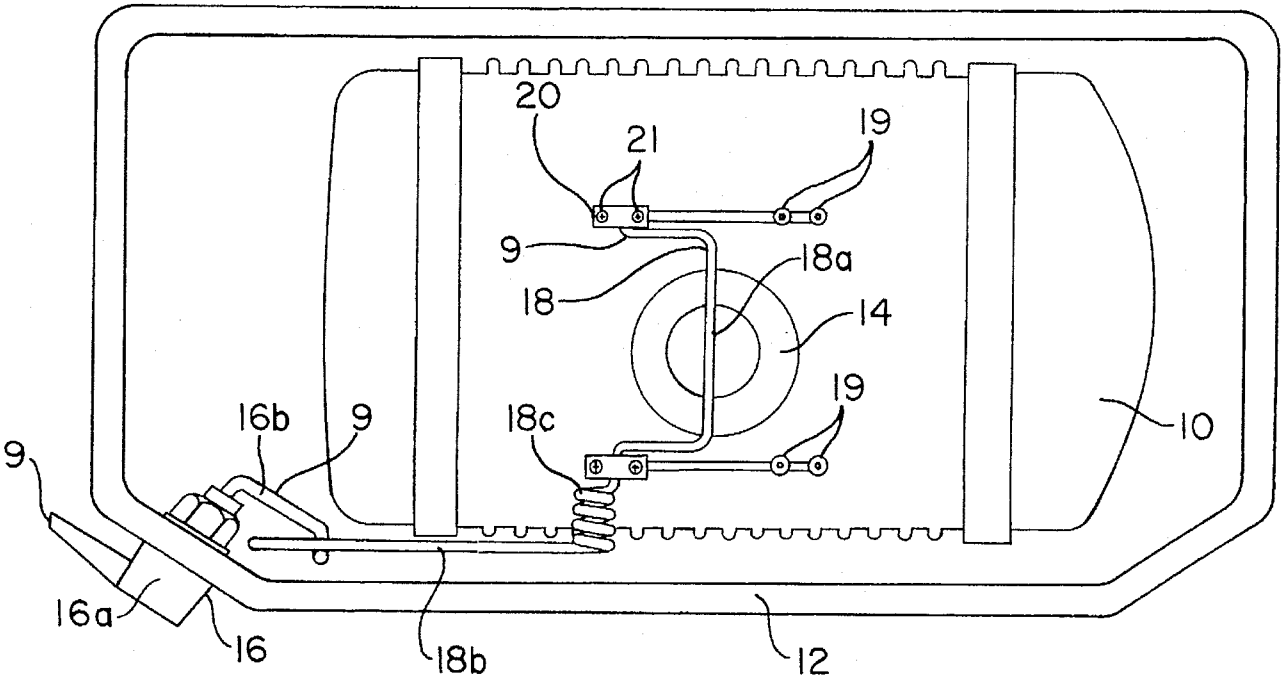
FIG. 1 is a top plan view of the trip lever mechanism in accordance with the claimed invention.
Figure 2:
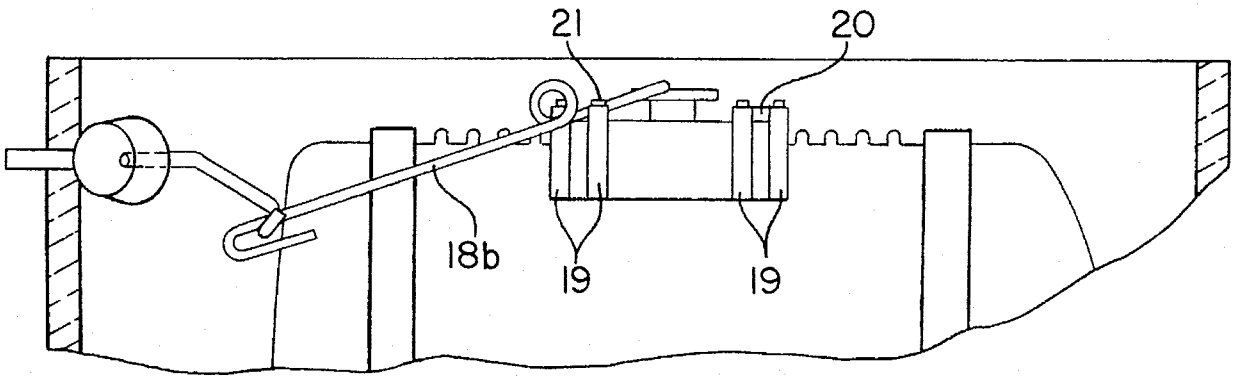
FIG. 2 is a front elevational view of the trip lever mechanism of FIG. 1.

Reference is now made to FIGS. 1 and 2 which depict a trip lever mechanism 9 connected to a tank 10. Tank 10 may be any of a number of button actuated tanks available in the industry such as a pressure assisted tank. Tank 10 is located within chinaware 12 and includes an actuation member in the form of a button 14 located atop the tank for initiating flushing. Since the button member 14 is inappropriately located for certain users such as the physically challenged, the trip lever mechanism of the present invention is incorporated onto the button actuated tank to convert it to a side trip lever actuated flushing system.

The trip lever mechanism includes an actuation member or trip lever arm 16 having a user end or handle **16*a* located externally of tank 10 which operates in the conventional manner and a hook or engagement end 16*b* which interacts with the energy absorbing member 18. Tank 10 may include a series of bosses 19 molded therein for connection of member 18 to tank 10. The bosses 19 may be located on both the left and right proximate button 14 to allow for connection of member 18 on the left or right of tank 10. This in turn allows for left or right side placement of the actuation member 16 on chinaware 12**.

Figure 3:
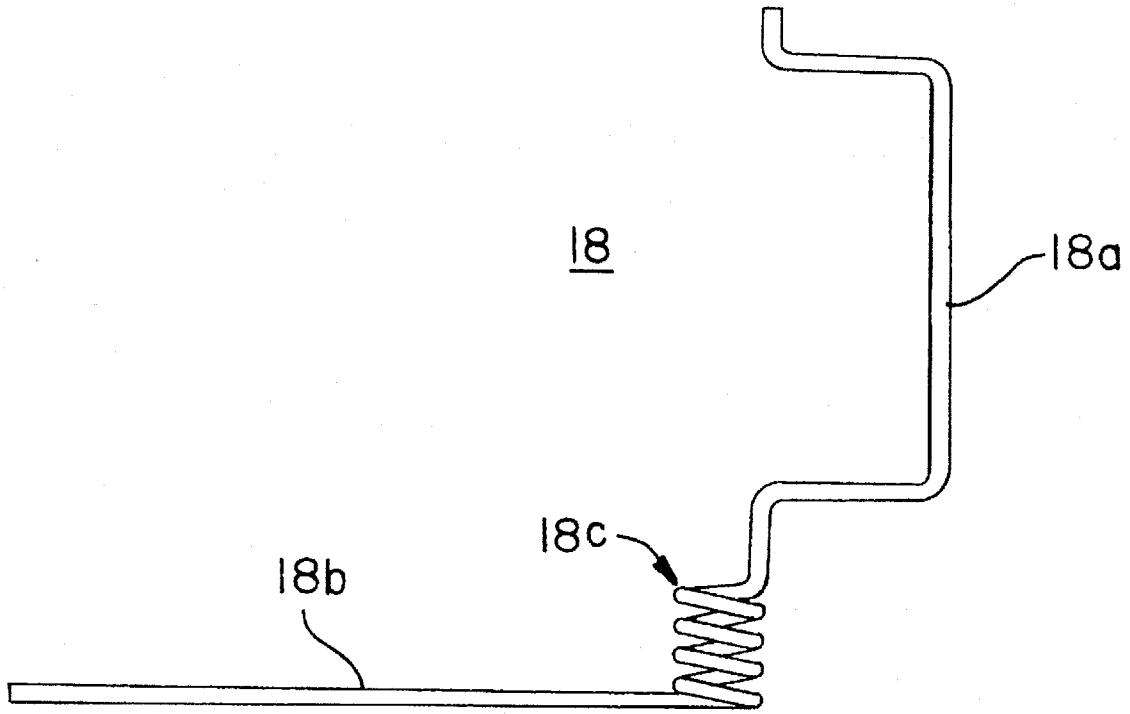
FIG. 3 is a top plan view of the energy absorbing member of the trip lever mechanism.
Figure 4:
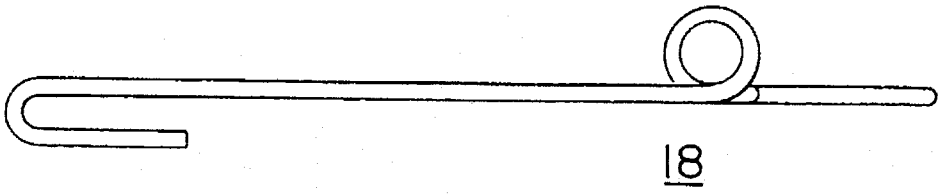
FIG. 4 is a side view of the energy absorbing member of FIG. 3.
Figure 5:
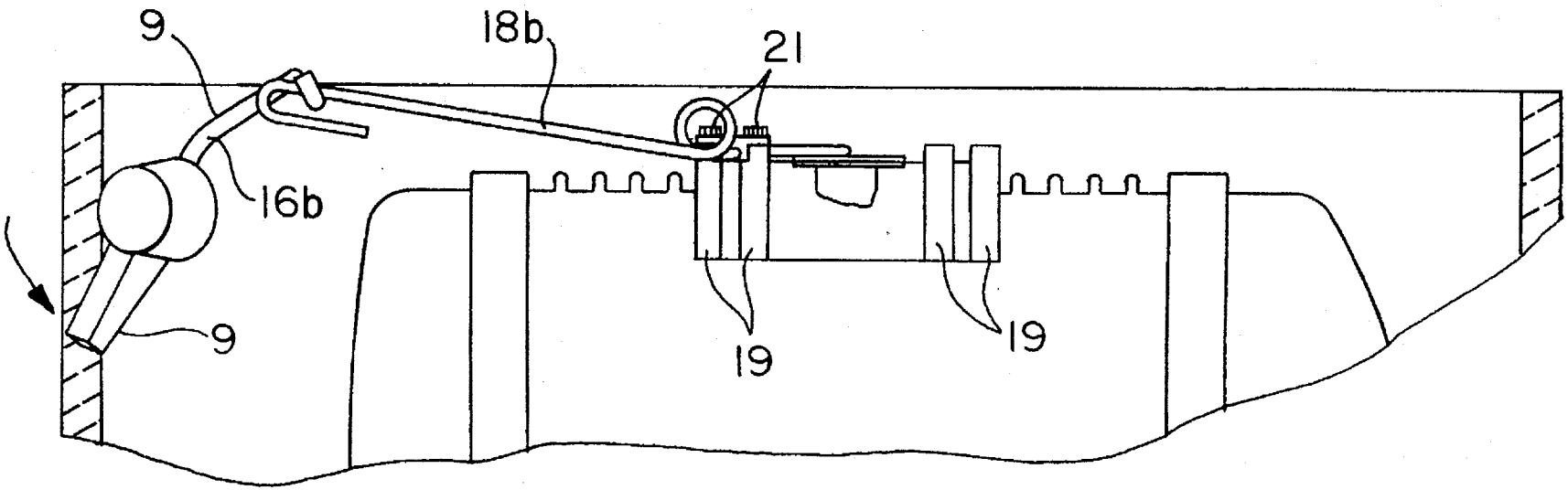
FIG. 5 is a front elevational view of an actuated trip lever mechanism.

As clearly depicted in FIGS. 3 and 4, the energy absorbing member 18 includes short end **18*a* which exhibits a flattened U-shaped end and which end traverses the button mechanism at its midpoint. End 18*a* is pivotally attached to the tank by any of a number of coupling means such as screws, straps, flanges and clips. FIGS. 1 and 2 illustrate retainer straps 20 and screws 21 secured in straps 20 to hold member 18 in position on tank 10. The attachment means allows movement of end 18*a* to pivot from its resting position as shown in FIG. 2 to its depressed state as shown in FIG. 5. Energy absorbing member 18 also includes long end 18*b* having a hook at one end which extends perpendicular to end 18*a* and connects to end 16*b* of trip lever arm 16. Energy absorbing member 18 further includes coil or helical section 18*c* of member 18 positioned midway between ends 18*a* and 18*b*. Coil section 18*c*** includes a series of twists which absorbs the force created by the actuation of the button. The energy absorbing member is typically constructed of stainless steel wire of 0.125 inch diameter although it is not limited to this material or size. Other materials such as brass or coated steel, which resists corrosion, may be used. Also, the diameter of the material may vary between 0.100" and 0.190".

Actual operation of the mechanism involves rotating handle 16*a* of actuation member 16 downward. Hook 16*b* rises and interacts with energy absorbing member 18 and lifts long end 18*b* upward. As end 18*b* travels upward U-shaped end 18*a* proceeds downward, about its pivotal axis, thus depressing button 14 on the pressure assisted tank 10. All of the contents in the tank are thereby released. Simultaneously, the kickback force associated with the pressure assisted tank is absorbed by the energy absorbing member 18 through the action of coil section 18*c*.

The trip lever mechanism of the present invention converts the button actuated flushing system into a conventional side trip lever flushing system. It provides convenience and ease for the user who is not comfortable with button actuated members which are located atop the tank. It also allows for placement of items atop the tank cover which is otherwise not feasible with conventional button actuation tanks. Moreover, it reduces the discomfort and annoying kickback associated with button actuated mechanisms.

Although, illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A toilet trip lever mechanism for use with a pressure flush toilet including a tank and a button member coupled to said tank comprising:

an energy absorbing member;

a flush actuation member coupled to said energy absorbing member; and a coupling means coupling said energy absorbing member to said tank, said energy absorbing member contiguous with said button member, said energy absorbing member including a U-shaped section, a coil section, and a hook section, said U-shaped section traversing said button member and said hook section linked to said flush actuation mechanism.

2. The toilet trip lever mechanism of claim 1 wherein said energy absorbing member has a diameter within the range of 0.100 and 0.190 inch.

3. The toilet trip lever mechanism of claim 1 wherein said energy absorbing member is fabricated of stainless steel wire with a diameter of 0.125 inch.

4. The toilet trip lever mechanism of claim 1 wherein said tank includes bosses molded therein and said coupling means includes a pair of straps and a set of screws, said screws secured in said straps and in said bosses.

5. The toilet trip lever mechanism of claim 4 wherein said energy absorbing member is secured under said straps.

6. The toilet trip lever mechanism of claim 1 wherein said flush actuation member includes a handle located externally of said tank and a hook member coupled to said handle and located internally of said tank, said hook member linked to said hook section of said energy absorbing member.

7. The toilet trip lever mechanism of claim 1 wherein said energy absorbing member is fabricated of a material selected from the group consisting of steel or brass.

* * * * *